US006811042B2

(12) United States Patent
Kelly et al.

(10) Patent No.: US 6,811,042 B2
(45) Date of Patent: Nov. 2, 2004

(54) MODULAR RACK

(76) Inventors: Daniel Kelly, 9 Roxbury Dr., Medford, NJ (US) 08055; Emerson B. Donnell, P.O. Box 386, Basking Ridge, NJ (US) 07920

( * ) Notice: Subject to any disclaimer, the term of this patent is extended or adjusted under 35 U.S.C. 154(b) by 14 days.

(21) Appl. No.: 10/332,610

(22) PCT Filed: May 31, 2002

(86) PCT No.: PCT/US02/16930

§ 371 (c)(1),
(2), (4) Date: Jan. 9, 2003

(87) PCT Pub. No.: WO03/101259

PCT Pub. Date: Dec. 11, 2003

(65) Prior Publication Data

US 2004/0026346 A1 Feb. 12, 2004

(51) Int. Cl.[7] ..... A47F 7/00
(52) U.S. Cl. ..... 211/74; 211/194; 211/85.18; 206/509
(58) Field of Search ..... 211/74, 194, 59.4, 211/85.18, 188; 206/509, 511

(56) References Cited

U.S. PATENT DOCUMENTS

D233,817 S 12/1974 Matthews et al.
4,911,303 A 3/1990 Andersson
4,942,967 A 7/1990 Schneider
D336,408 S 6/1993 Tersch et al.
5,370,245 A 12/1994 Tersch et al.
5,593,037 A * 1/1997 Ohayon ..... 206/509
6,026,958 A * 2/2000 Kelly et al. ..... 206/503
6,135,297 A 10/2000 DeShazo et al.
6,142,300 A * 11/2000 Kelly et al. ..... 206/503
6,170,675 B1 1/2001 Follman et al.
6,290,074 B1 9/2001 Syvuk et al.

* cited by examiner

*Primary Examiner*—Robert W. Gibson, Jr.
(74) *Attorney, Agent, or Firm*—RatnerPrestia

(57) ABSTRACT

A stackable storage unit may be vertically stacked for storage and transportation of storable members. The storage unit comprises at least one pair of rails extending in a first direction and having a contoured surface for supporting a surface area of a generally cylindrical storable member. At least two generally vertical walls extend in the first direction on opposing ends of the storage unit. The walls comprise a flat top surface with a plurality of alignment openings therein. A plurality of alignment tongues extending from the bottom of the wall are positioned and configured to engage corresponding alignment openings in an underlying storage unit. A rib structure underlies the rails and connects the walls to the rails. Feet extend below the bottom of the alignment tongues and support the storage unit on a generally flat surface or fit inside the walls of an underlying storage unit.

28 Claims, 8 Drawing Sheets

MODULAR RACK

TECHNICAL FIELD

This invention relates generally to a modular rack for storing generally cylindrical storable members, such as water bottles, and more specifically to stackable storage units having two directional alignment and interlock features that can be stacked to form a stable, transportable modular rack.

BACKGROUND OF THE INVENTION

Generally cylindrical water bottles are used in water coolers. These water bottles are typically handled, transported, and stored in varying quantities. For easier handling, transport, and storage, the water bottles may be loaded in carriers designed to accommodate multiple bottles. To accommodate the varying quantities of bottles, aluminum and plastic modular racks are available comprising carriers designed to be vertically stackable. These modular racks are formed by stacking bottle storage units or carriers. The storage units have feet extending from the bottom of the unit with openings therein and interlocking projections extending from the top of the unit. The feet can support the unit on the ground or can be interlocked with projections from another unit to form a vertical stack.

Existing modular racks, however, are difficult to align, since each foot must be aligned in space with a corresponding projection so that the feet of the top unit can be lowered onto the projections of the bottom unit. Alignment becomes more difficult when the units contain full water bottles requiring the use of equipment, such as a forklift to handle the unit. A further problem with existing modular racks is that the interlock feature can be disengaged by shock or vibration during handling and transport, damaging water bottles and the rack. Water bottles can also be damaged by contact with relatively sharp exposed ribs in existing modular racks. A still further problem with existing modular racks is that they are easily damaged by handling equipment, such as forklifts. Yet another problem with existing modular racks is that they can cause damage to automatic loading equipment if they are not correctly oriented when stacked, because they are not symmetrical front to back.

To overcome the shortcomings of existing modular racks, a need exists for a vertically stackable modular rack that provides ease of alignment, secure interlocking, optimum bottle protection, and reduced susceptibility to damage by handling equipment.

SUMMARY OF THE INVENTION

To meet these and other needs, and in view of its purposes, an exemplary embodiment of the present invention provides a stackable storage unit that may be vertically stacked to form a modular rack for storage and transportation of storable members, such as water bottles. The storage unit comprises at least one pair of rails extending in a first direction (generally parallel to the longitudinal axis of a water bottle resting on the pair of rails) and having a contoured surface for supporting a surface area of a generally cylindrical storable member. At least two generally vertical walls extend in the first direction on opposing ends of the storage unit. The walls comprise a flat top surface with a plurality of alignment openings therein. A plurality of alignment tongues extending from the bottom of the wall are positioned and configured to engage corresponding alignment openings in an underlying storage unit. A connecting structure (e.g., a rib structure) underlies the rails and connects the walls to the rails. Feet extend to a level below the bottom of the alignment tongues and support the storage unit on a generally flat surface or fit inside the walls of an underlying storage unit when stacked.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
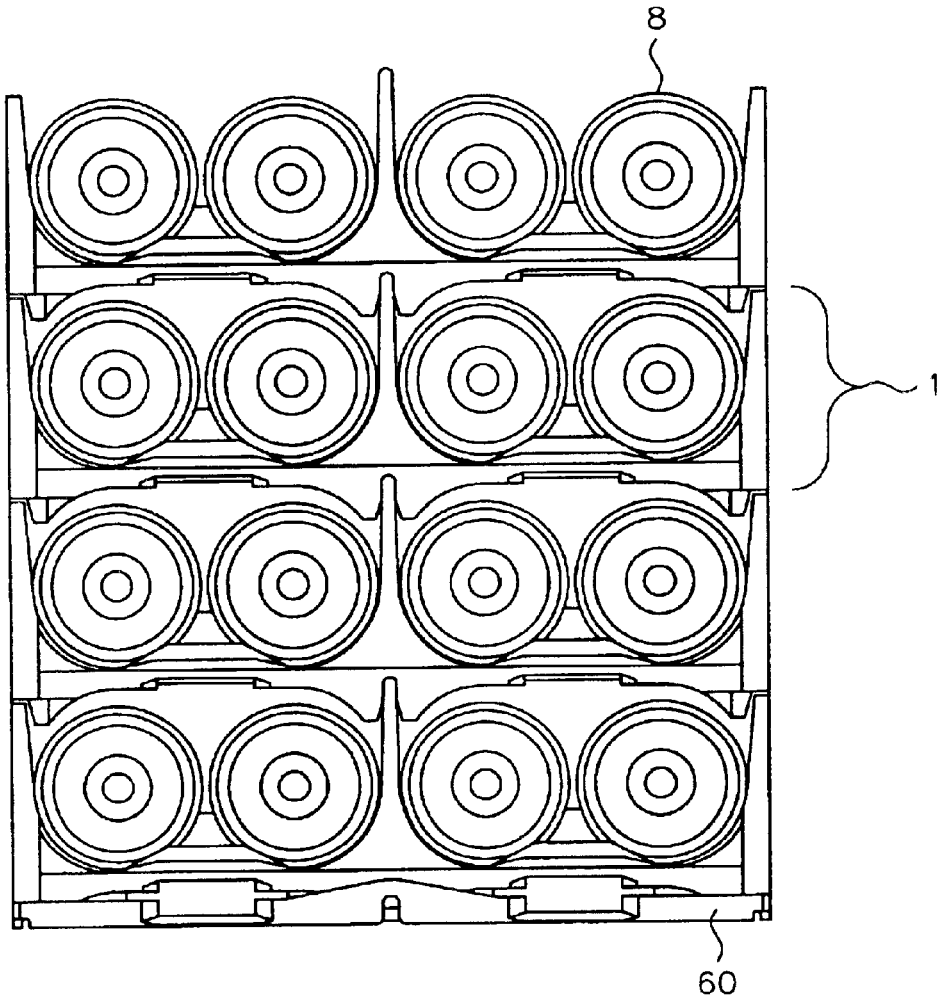
FIG. 1 is a stack of storage units according to an exemplary embodiment of the present invention with water bottles stored therein.

Referring now to the drawing, in which like reference numbers refer to like elements throughout, FIG. 1 shows a stack of four stackable storage units 1, according to an exemplary embodiment of the present invention. Each storage unit 1 holds a plurality of water bottles 8, and is interlocked with an underlying storage unit or with a frame 60. The modular rack of the present invention enhances alignment of vertically stacked storage units, increasing the margin for initial displacement, and providing a quicker and easier two-step alignment procedure. The modular rack of the present invention also enhances interlock stability, reduces bottle damage and reduces stack height.

When used herein, the following words and phrases have the meaning provided. Left, right, up, upward, above, down, downward, below, underlying, and the like shall indicate that direction when looking at FIG. 1. Front and forward indicate the direction out of FIG. 1, and back and backward indicate the direction into FIG. 1. Lateral indicates the axis extending from the left to the right of FIG. 1. Vertical indicates the axis extending from the bottom to the top of FIG. 1. Longitudinal indicates the axis extending into FIG. 1, being oriented generally parallel to the axis of generally cylindrical storable members (e.g., bottles) stored in a storage unit. Inward and inwardly indicates the direction toward the center of the rack.

Figure 2:
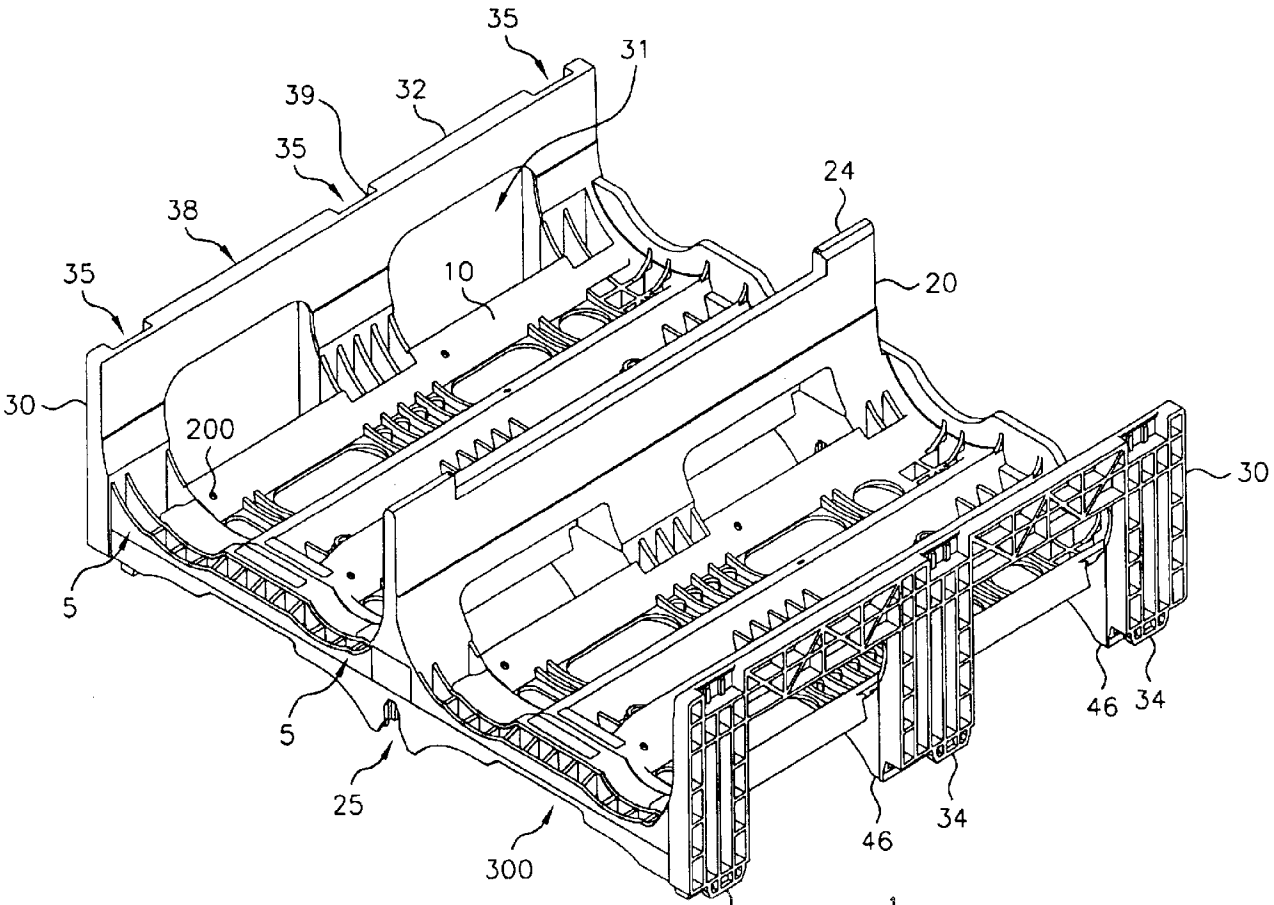
FIG. 2 is a top isometric view of a storage unit according to an exemplary embodiment of the present invention.
Figure 3:
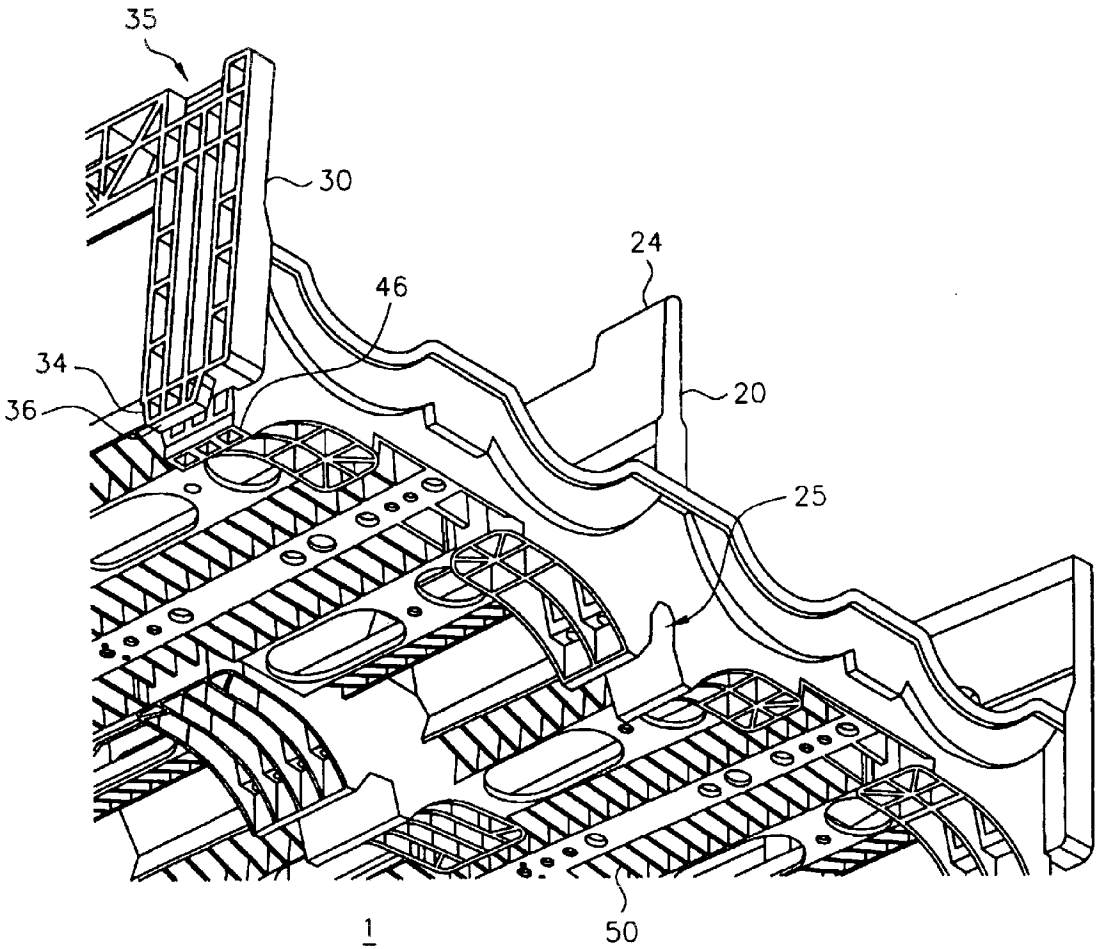
FIG. 3 is a bottom isometric view of the storage unit shown in FIG. 2.

Stackable storage unit 1 as shown in greater detail in FIGS. 2 and 3 provides optimized protection for bottles stored therein, and enhanced alignment and interlocking capabilities. Storage unit 1 is also configured to reduce damage by handling equipment, such as forklifts and to reduce damage to automated loading equipment. Generally cylindrical storable units, such as water bottles are stored in a plurality of apertures 5. Apertures 5 are bounded by two or more rails 10 having a surface contoured to support a generally cylindrical surface of a storable member (e.g., water bottle). Preferably, a pair of axially extending rails 10, oriented essentially parallel to the axes of apertures 5, define each aperture 5. Two 5-gallon water bottles or three 3-gallon water bottles can be stored on each pair of rails 10. Because the rails 10 are contoured, the contact a greater surface area of the water bottles resting on them, reducing any stress in the water bottles, as compared to flat or sharp ribs used in existing modular racks. Also, each pair of contoured rails provide lateral support to the water bottles, reducing damage that may be caused by lateral shifting of water bottles during transport and handling. While the exemplary storage unit 1 illustrated in FIGS. 2 and 3 comprises four apertures 5, each bounded by a pair of longitudinally extending rails 10, embodiments having a larger or smaller number of apertures are contemplated. Although rails 10 are described and illustrated with reference to generally cylindrical storable members, rails configured to support the longitudinal surfaces of a generally rectangular storable unit are also contemplated in the present invention.

To enhance alignment of storage unit 1 on an underlying storage unit, alignment features are provided for a two-step, two-directional alignment. One or more primary alignment tongues 24 extend from storage unit 1 in an essentially vertical direction, preferably upwardly from storage unit 1. In an exemplary embodiment of the present invention, two primary alignment tongues 24 extend upwardly from a first wall 20 located in the center of storage unit 1. In the exemplary embodiment illustrated in FIGS. 2 and 3, primary alignment tongues 24 and first wall 20 are oriented in a first direction, generally parallel to the axes of apertures 5. Primary alignment tongues 24 are preferably upwardly tapered, and may be positioned at the front and back of first wall 20.

Storage unit 1 further comprises a primary alignment groove 25. Primary alignment groove 25 is positioned opposite primary alignment tongues 24. For example, in the embodiment of storage unit 1 illustrated in FIGS. 2 and 3, where primary alignment tongues 25 extend upwardly from first wall 20, primary alignment groove 25 is positioned in the bottom of storage unit 1, positioned directly under first wall 20. Primary alignment groove 25 has a relatively wide initial opening which tapers to an opening that is sized to provide a relatively tight fit over primary alignment tongues 24 from an underlying storage unit.

In use, storage unit 1 is positioned above an underlying storage unit such that alignment groove 25 is positioned approximately over and oriented approximately parallel to primary alignment tongues 24 from an underlying storage unit. As storage unit 1 is lowered onto an underlying storage unit, alignment tongues 24 from the underlying storage unit enter the tapered portion of alignment groove 25. The taper in alignment groove 25 self-aligns storage unit 1 with the underlying storage unit by laterally centering alignment groove 25 on alignment tongues at the front and back of the underlying storage unit. In the exemplary embodiment illustrated in FIGS. 2 and 3, primary alignment features 24 and 25 allow an overlying storage unit to be laterally displaced relative to an underlying storage unit by up to an inch.

Storage unit 1 further comprises at least two generally vertical second walls 30 disposed on opposing lateral ends of storage unit 1. Second walls 30 extend in the first direction, (i.e., longitudinally). As shown in FIGS. 2 and 3, access openings 31 may be provided in second walls 30 to allow access to water bottles stored in storage unit 1. Second walls 30 comprise a flat top surface or sliding face 32 with a plurality of alignment openings 35 therein. A plurality of secondary alignment tongues 34 extend downwardly from the bottom of second walls 30. Secondary alignment tongues 34 are positioned and configured to engage corresponding alignment openings 35 in an underlying storage unit. As shown in FIGS. 2 and 3, alignment openings 35 preferably extend partially into second walls 30 toward apertures 5, and are each bounded by an outside face 39 (i.e., facing away from first wall 20). As shown in FIGS. 2 and 3, alignment openings 35 may be open to the outside surface 38 of second walls 30, exposing outside faces 39 (shown in FIG. 3).

Secondary alignment tongues 34 may be tapered to provide ease of engagement with alignment openings 35, and preferably terminate in a flat surface 36. In an engaged position, secondary alignment tongues 34 extend into alignment openings 35 and abut outside faces 39 of second walls 30, locking vertically stacked storage units together such that storage unit 1 is restrained from moving laterally or horizontally with respect to an underlying storage unit.

Feet 46 extend downwardly from the bottom of storage unit 1 and support storage unit 1 when it is resting on a generally flat surface, such as a floor or the ground. Feet 46 extend below alignment tongues 34, protecting alignment tongues 34 from wear and damage from contact with the ground. Feet 46 may be located adjacent alignment tongues 34 with an opening between corresponding feet 46 and alignment tongues 34 to receive second wall 30 at the locations of alignment openings 35. Primary alignment tongues 24 and primary alignment groove 25 are disposed to engage before alignment tongues 34 and alignment openings 35 when vertically stacked storage units are brought together. In this way, alignment tongues 34 are aligned to alignment openings 35 in a lateral direction by primary alignment features 24 and 25.

Alignment of vertically stacked storage units may be performed in a two-step procedure. Accordingly, primary alignment tongues 24 of an underlying storage unit may be engaged in primary alignment groove 25 of an overlying storage unit, to provide lateral alignment in a first step. Primary alignment groove 25 is tapered to self-center over primary alignment tongues 24. In the first step, primary alignment groove 25 may be displaced by almost half of its initial width (about one inch) from alignment with primary alignment tongues 24, and alignment tongues 34 may be displaced from alignment openings 35 in the longitudinal direction by a margin of up to about ten inches. When alignment tongues 34 are longitudinally displaced relative to alignment openings 35, flat surface 36 of alignment tongues 34 rest on sliding surface 32 of second walls 30.

In a second step of the two-step procedure, the overlying storage unit is slid longitudinally forward or backward until the alignment tongues 34 of the overlying storage unit align with the alignment openings 35 of the underlying storage unit. When alignment tongues 34 are aligned with alignment openings 35, gravity causes the alignment tongues to engage in the alignment openings interlocking the vertically stacked storage units. Because the flat surface 36 on the bottom of alignment tongues 34 slides on the flat sliding surface 32 on the top of second walls 30, there is very little friction, and sliding can be accomplished with a small longitudinal force. Alignment tongues 34 are held on sliding surface 32 by engagement of self-centering primary alignment groove 25 over primary alignment tongues 24.

In the two-step alignment procedure, lateral alignment can be accomplished without simultaneously controlling longitudinal alignment in the first step, and longitudinal alignment can be accomplished without simultaneously controlling lateral alignment. Because each alignment axis can be addressed separately, the two-step alignment procedure (slide and lock) is easy to perform and requires minimal time and provides greater margins for initial displacement during alignment.

Each pair of rails is connected together and interconnected to the first and second walls by a rib structure 50. Rib structure 50 is disposed under rails 10 such that rib structure 50 does not contact a storable member supported by rails 10. Rib structure 50 comprises an interconnected network of generally vertical ribs providing vertical support to rails 10 as well as maintaining the position and alignment of rails 10, first wall 20, and second walls 30 relative to each other. As shown in FIGS. 2 and 3, rib structure 50 may have openings between the vertical ribs, reducing material, weight, and cost of storage unit 10.

Rib structure 50 may be contoured to define a top portion of apertures 5, reducing the clearance between water bottles stored on an underlying storage unit and an overlying storage unit. Accordingly, the maximum bounce of a water bottle due to vibration in transport and handling is reduced, as well as, damage resulting from such bounce.

Storage unit 10 may comprise a variety of materials having the appropriate strength for supporting a plurality of storable units. In an exemplary embodiment of the invention, storage unit 10 comprises polycarbonate, and is formed by an injection molding process.

Figure 4:
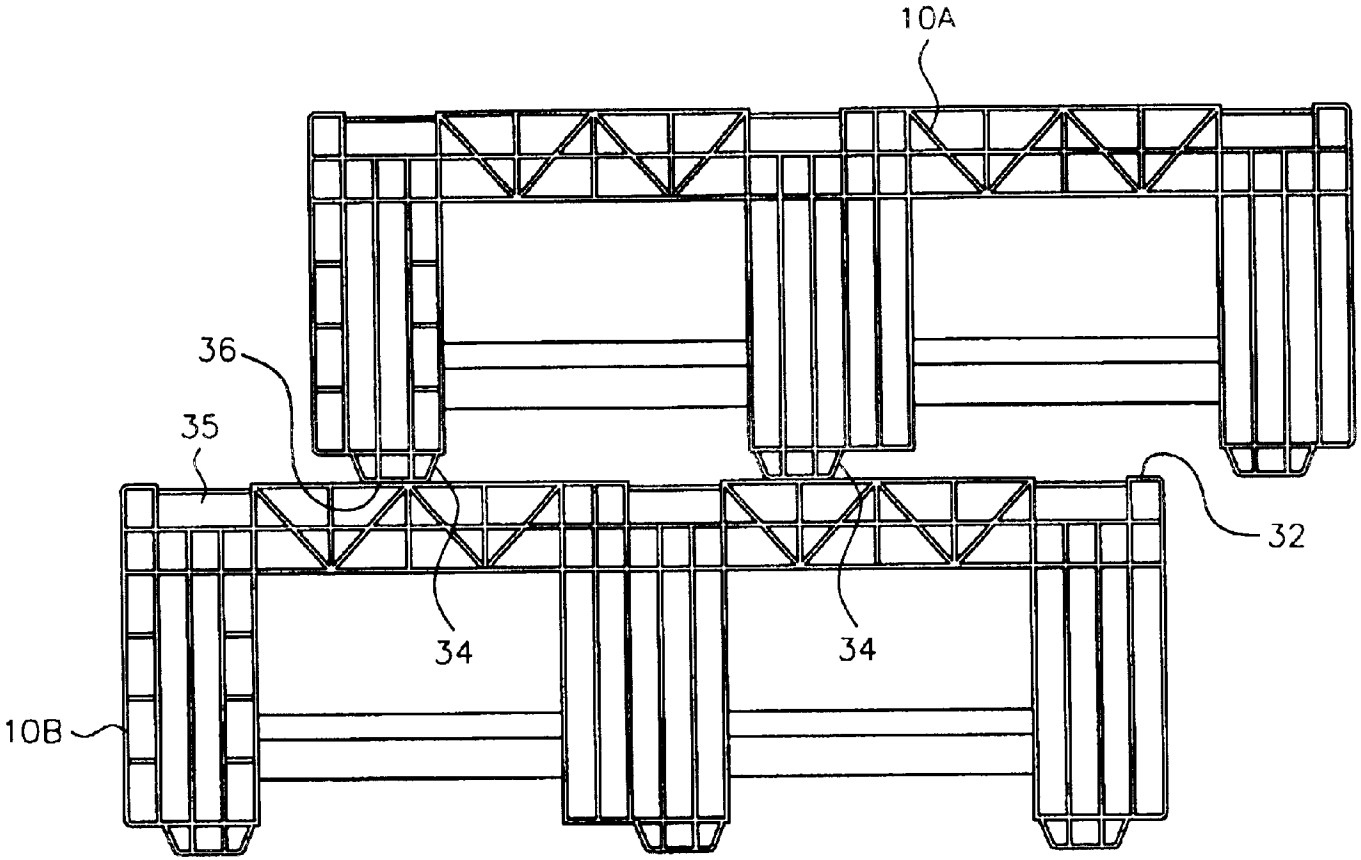
FIG. 4 is a side view of two storage units according to an exemplary embodiment of the present invention, showing alignment and interconnect features.

Referring now to FIG. 4, an overlying storage unit 10A is aligned in the lateral direction and displaced in the longitudinal direction relative to an underlying storage unit 10B. As shown in FIG. 4, flat surfaces 36 of alignment tongues 34 rest on sliding face 32 of second wall 30. Storage units 10A and 10B are between the first and second steps of the two-step alignment procedure described herein. In an exemplary embodiment of the invention, a forklift operator can land overlying storage unit 10A within about one inch of alignment with underlying storage unit 10B in the lateral direction and within about ten inches in the longitudinal direction. The self-centering primary alignment groove (not shown) will self-center on primary alignment tongues (not shown) bringing alignment tongues 34 of overlying storage unit 10A to rest on sliding surface 32 of underlying storage unit 10B. The forklift operator can then slide overlying storage unit 10A on sliding surface 32 of underlying storage unit 10B until alignment tongues 34 engage or interlock with alignment opening 35 of underlying storage unit 10B.

Figure 5:
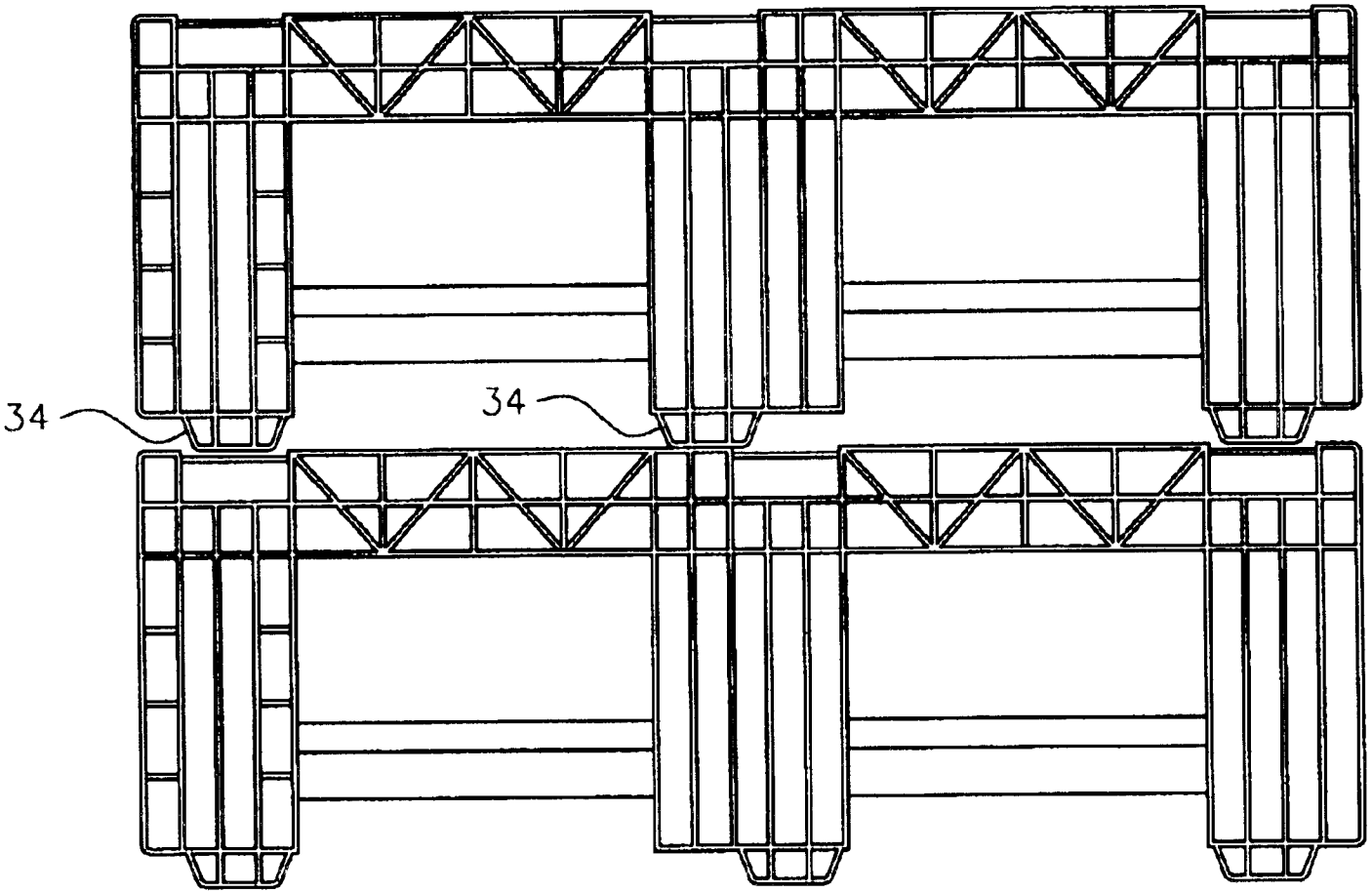
FIG. 5 is a side view of two storage units according to an exemplary embodiment of the present invention, showing a feature for preventing incorrect orientation of a vertically stacked storage unit.

Referring now to FIG. 5, alignment tongues 34 may be variably spaced or sized to prevent interlocking of vertically stacked storage units that are incorrectly oriented. Incorrect orientation can cause damage to automatic handling equipment by collision with non-symmetrical features of storage units 10. In the exemplary embodiment illustrated in FIG. 5, alignment tongues 34 have different spacing so that they can not be simultaneously engaged when they are incorrectly oriented, as shown.

Figure 6:
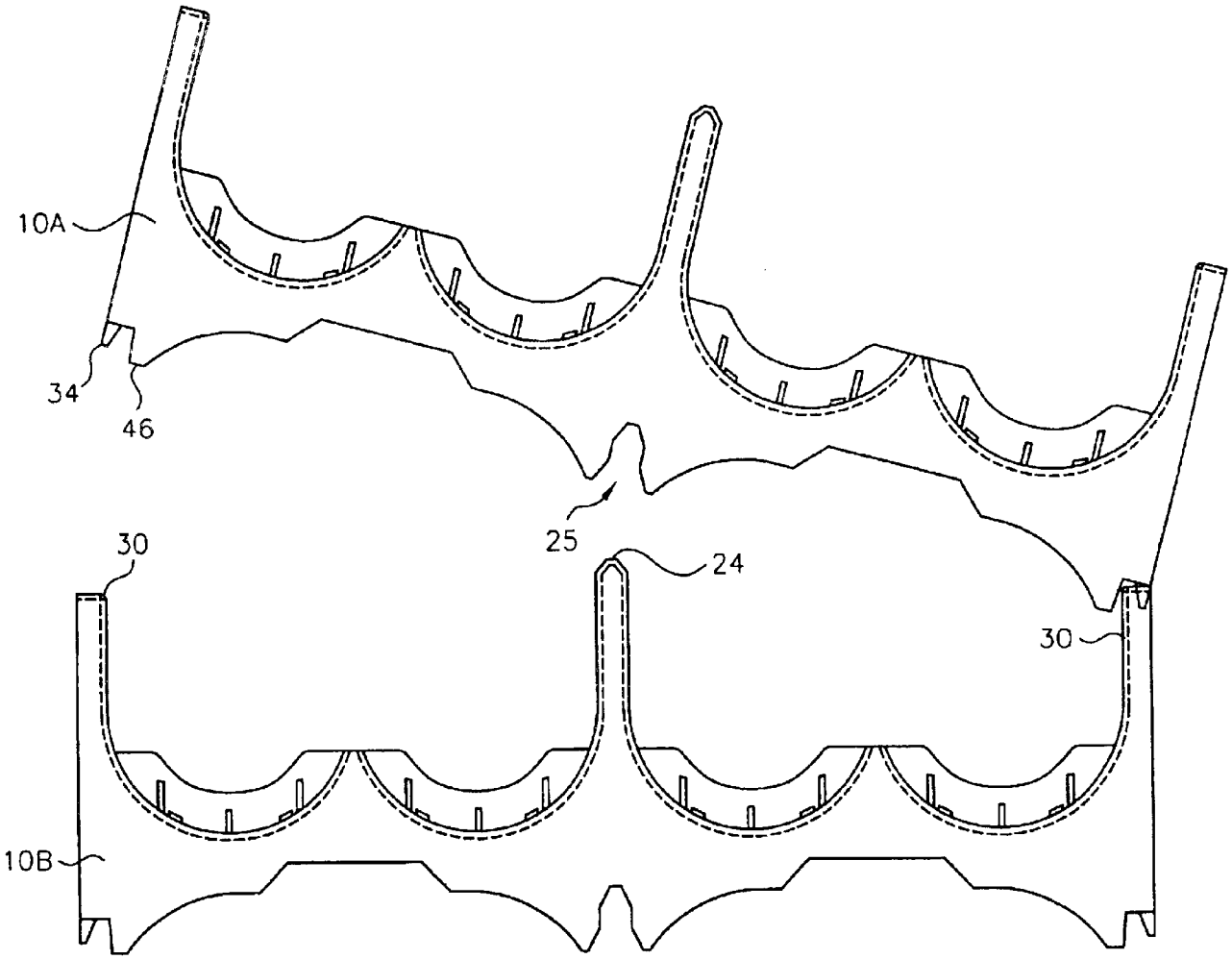
FIG. 6 is a front view of two storage units showing a primary alignment groove providing enhanced alignment and interlock functions.

Referring now to FIG. 6, the interlock features of an exemplary embodiment of the invention provide interlock stability. Second walls 30 of underlying storage unit 10B are trapped between alignment tongues 34 and feet 46 of overlying storage unit 10A. Primary alignment tongues 24 of underlying storage unit 10B are trapped in primary alignment groove 25 of overlying storage unit 10A. Because alignment tongues 34, feet 46, and primary alignment groove 25 do not support overlying storage unit 10A when stacked, they do not affect the stack height of vertically stacked storage units. Accordingly, the length of engagement of these structures can be increased without adversely affecting the stack height of a stack of storage units. Increased engagement length provides greater interlock stability. In an exemplary embodiment of the present invention, a storage rack can be bounced up to 2.75 inches and return to a fully interlocked position, providing interlock stability during transportation and handling of the storage units and modular racks comprising vertically stacked storage units. Also, because second wall 30 of underlying storage unit 10B is received in an opening between feet 46 and alignment tongues 34 of overlying storage unit 10A, pivoting by overlying storage unit 10A during transport or handling, as shown in FIG. 6 dpoes not disturb the interlocking of storage units 10A and 10B. Second wall 30 of underlying storage unit 10B remains in the opening between feet 46 and alignment tongues 34 of overlying storage unit 10A.

Another advantage of the present invention is that stack height can remain essentially constant over the life of a storage unit. In an exemplary embodiment of the invention, as described above, feet 46 do not affect stack height. Accordingly, dimensional changes of feet 46 due to wear will not change the stack height of vertically stacked storage units. This allows storage units to be dimensioned for a closer fit at the top of vertically stored water bottles, limiting the height to which water bottles can bounce during transport and handling, and thereby reducing damage to the water bottles. A constant stack height also makes the use of automated loading equipment easier, because the automated equipment does not have to compensate for stack height variations.

Yet another advantage of the present invention is that the overall stack height of a modular rack can be maintained at a desirable (minimum) height. In an exemplary embodiment of the invention, stack height can be maintained at 105.5 inches for a stack of eight storage units. This stack height allows a stack of eight storage units to be easily loaded in a standard 110 inch truck. Reduced stack height also facilitates easier handling of vertically stacked storage units.

Figure 7:
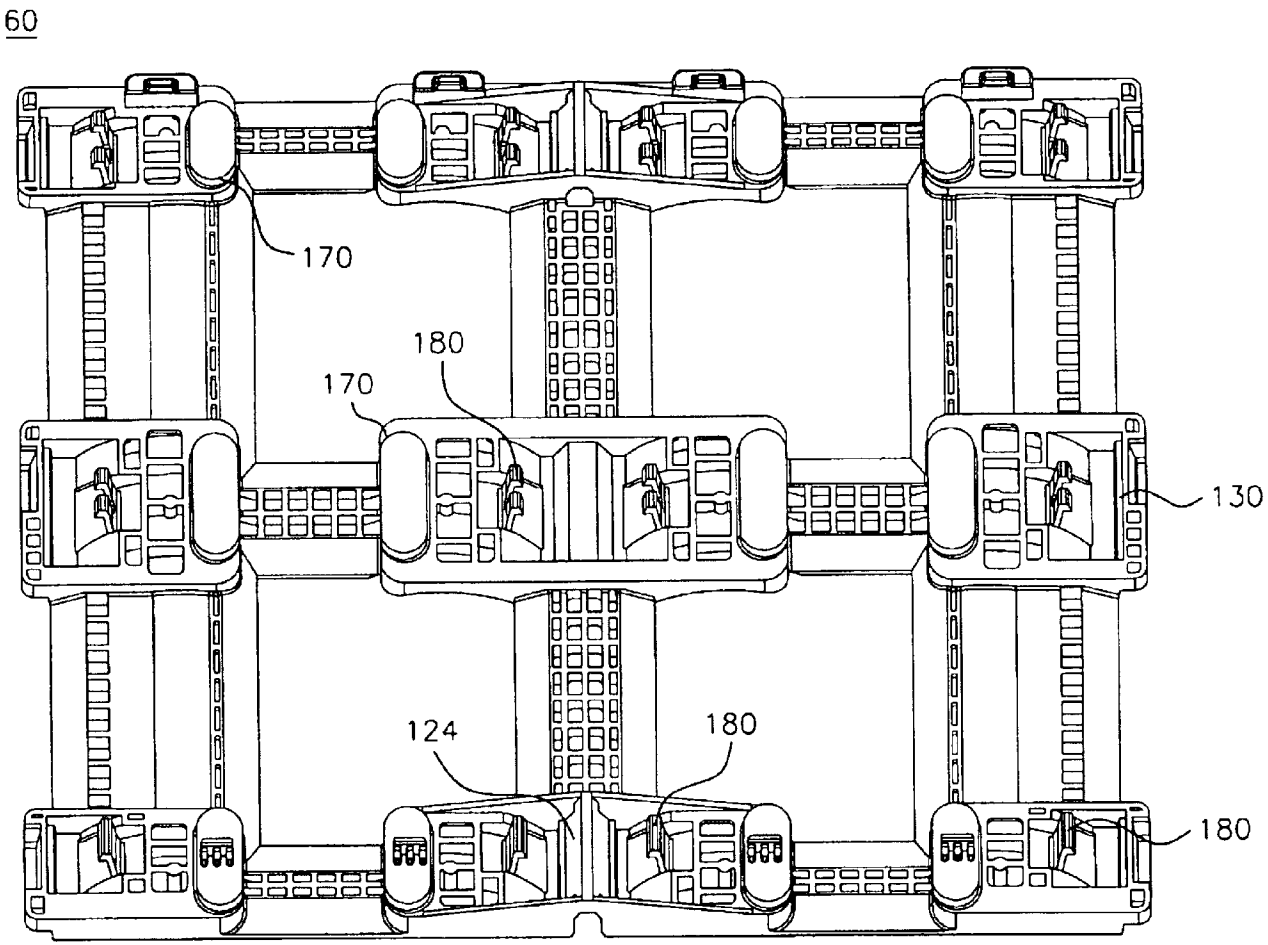
FIG. 7 is top view of a frame for supporting one or more stacked storage units according to an exemplary embodiment of the present invention.
Figure 8:
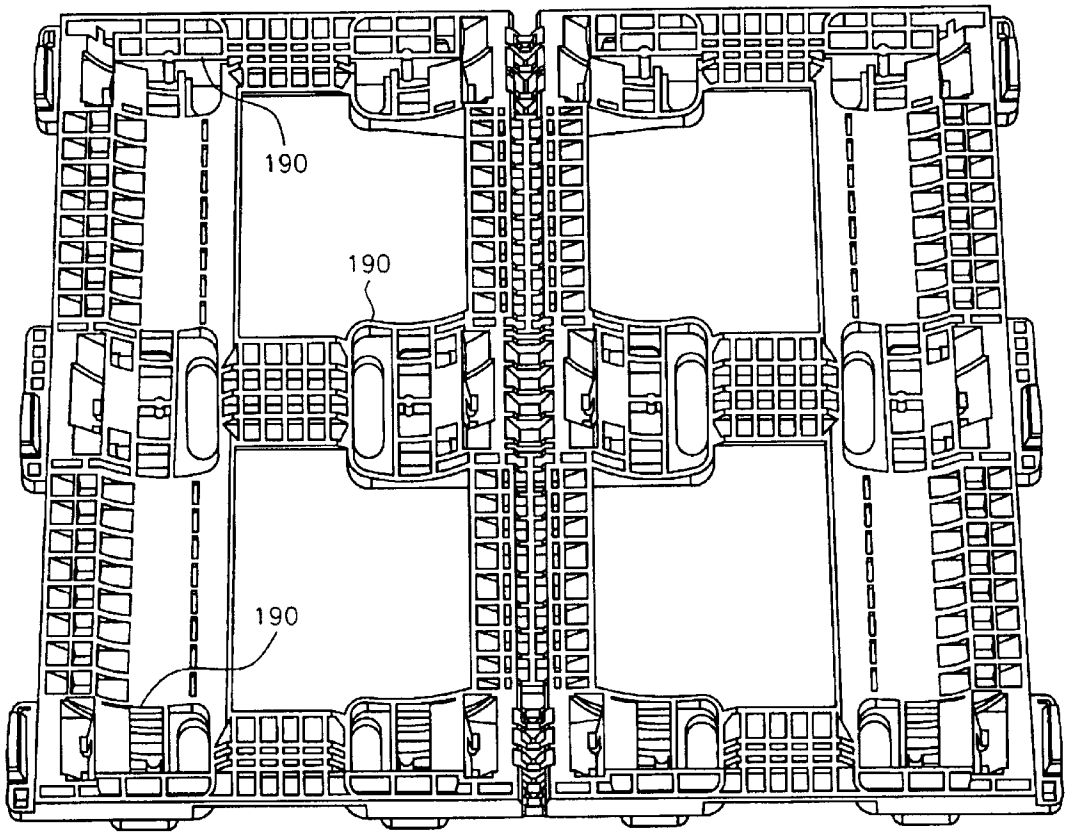
FIG. 8 is a bottom view of the frame shown in FIG. 7.

The modular rack of the present invention may further comprise a frame 60, as shown in FIG. 1 and illustrated in greater detail in FIGS. 7 and 8. In an exemplary embodiment as shown in FIGS. 7 and 8, simulated primary alignment tongues 124 and simulated second walls 130 are provided for engagement with primary alignment groove 25 and alignment tongue 34 and feet 46 of a storage unit 10 (as shown in FIGS. 2 and 3). Support pads 170 are disposed to support rib structure 50 of storage unit 10. Snap fingers 180 engage storage unit 10 when it is lowered onto frame 60. The bottom of frame 60 has continuous smooth ribs 190, allowing frame 60 and storage units 10 stacked thereon to be transported on a conveyor roller.

Referring again to FIG. 2, rib structure 50 is recessed at the front of storage unit 1. Ribs or other structures which are generally at the level of storable members as they are loaded on a storage rack and unloaded from the storage rack can come into contact with the storable members as they slide into and out of storage apertures. The recessed rib structure reduces damage to storable members and labels on the storable members during loading and unloading of the storable members.

Longitudinal rails 10 may be continuous to maintain longitudinal alignment of storable members during loading and unloading. This longitudinal alignment prevents storable members from turning or cocking in the rack during loading and unloading. This feature provides improved loading and unloading and reduced damage to storable members compared to racks with generally transverse supports that allow storable members to turn and jam during loading and unloading.

To prevent water bottles from sliding longitudinally on rails 10, friction plugs 200 may be installed on rails 10, as shown in FIG. 2. Friction plugs may, for example, comprise rubber, plastic, or other material, preferably providing a high coefficient of friction. Friction plugs may be installed on rails 10 with adhesive, snapped into holes formed in rails 10, or attached using other techniques appropriate to the materials used for rails 10 and friction plugs 200.

To reduce damage to water bottles and the modular rack by handling equipment such as forklifts, storage unit 10 may comprise forklift pockets 300, as shown in FIG. 2. Forklift pockets 300 provide a specific location to drive the fork of a forklift, and provide additional clearance from water bottles stored in an underlying storage unit. Because forklift pockets 300 provide a specific location for forklift forks, forklift pockets 300 can be easily reinforced. Forklift pocket 300 may be provided with wide lead-in radii to direct the forks into the opening. To prevent the rack from sliding off the blades of a forklift, forklift pockets may have mounted thereon forklift friction plugs (not shown) similar to the friction plugs 200 (in FIG. 2).

Although illustrated and described above with reference to certain specific embodiments, the present invention is nevertheless not intended to be limited to the details shown. Rather, various modifications may be made in the details within the scope and range of equivalents of the claims and without departing from the invention.

What is claimed is:

1. A stackable storage unit, comprising:

at least one pair of rails extending in a first direction and having a contoured surface for supporting a surface area of a storable member;

at least two generally vertical walls extending in the first direction disposed on opposing ends of the storage unit, the walls comprising a flat top surface with a plurality of alignment openings therein and a plurality of alignment tongues extending from the bottom of the wall, the alignment tongues positioned and configured to engage corresponding alignment openings in an underlying storage unit;

a rib structure underlying the rails and connecting the walls to the rails; and feet sized and configured to extend below the bottom of the alignment tongues and to support the storage unit on a generally flat surface and positioned to fit inside the walls of an underlying storage unit.

2. The storage unit of claim 1 wherein the feet and the alignment tongues form interlock grooves that receiving the walls of an underlying storage unit, restraining the walls in a second direction essentially perpendicular to the first direction.

3. The storage unit of claim 1 wherein the alignment opening is enclosed by the wall on three sides.

4. The storage unit of claim 1 wherein the at least two generally vertical walls have openings therein to allow access to the storable member.

5. The storage unit of claim 1 wherein the rib structure has openings therein to allow access to the storable member.

6. The storage unit of claim 1 wherein the rails are continuous to prevent storable members from jamming during loading and unloading.

7. The storage unit of claim 1 wherein the rib structure is recessed at the front of the storage unit.

8. A stackable storage unit, comprising:

a plurality of storage apertures, each bounded by two or more rails having a contoured surface to support curved surface areas of one or more storable members;

a first wall interconnected with the rails and extending to an elevation above the storage apertures and terminating in one or more primary alignment tongues;

a self-centering primary alignment groove disposed directly below the one or more primary alignment tongues and configured to receive a first alignment tongue from an underlying storage unit, the primary alignment groove centering the storage unit over the underlying storage unit and restraining the storage unit in a first direction; and at least one second wall interconnected with the rails and first wall and extending to an elevation above the storage apertures and terminating at its top in a sliding face having two or more secondary alignment openings therein and at its bottom in two or more secondary alignment tongues extending downwardly from the at least one second wall and terminating in a flat surface configured to slide on a sliding face of the underlying storage unit, the two or more secondary alignment tongues configured to engage in corresponding secondary alignment openings in the underlying storage unit and restrain the storage unit in a second direction essentially perpendicular to the first direction.

9. The storage unit of claim 8 wherein the storage unit comprises a bottom surface contoured to form a top of the storage apertures of the underlying storage unit.

10. The storage unit of claim 8 wherein the apertures are non-continuous, horizontal cylinders open to a front of the storage unit for removing generally cylindrical storable members therefrom.

11. The storage unit of claim 10 wherein each aperture is configured and sized to hold two, five-gallon water bottles.

12. The storage unit of claim 10 wherein each aperture is configured and sized to hold three, three-gallon water bottles.

13. The storage unit of claim 8 further comprising a rib structure interconnecting the rails, first wall and one or more second walls, the rib structure comprising reinforced, tapered fork lift openings to prevent damage from handling the storage unit with a forklift.

14. The storage unit of claim 13 further comprising friction plugs mounted on the rails to prevent storable units from sliding on the rails.

15. The storage unit of claim 13 further comprising forklift friction plugs mounted on the forklift pockets to prevent storable units from sliding off the forklift.

16. The storage unit of claim 8 comprising two second walls positioned at each of two ends of the storage unit with the first wall centered between the second walls.

17. The storage unit of claim 16 further comprising feet integral with the rib structure and configured to support the storage unit on a generally flat surface and positioned to fit inside of the second walls of an underlying storage unit.

18. The storage unit of claim 17 wherein the feet and the secondary alignment tongue form interlock grooves therebetween receiving the second walls of an underlying storage unit.

19. The storage unit of claim 8 further comprising a frame mounted under the storage unit and configured for use on a roller conveyor.

20. The storage unit of claim 19 wherein the frame snaps onto the storage unit.

21. An interlock mechanism for aligning and restraining a first storage unit on a second storage unit, comprising:

a plurality of openings in the top surface of a generally vertical wall of the second storage unit, enclosed in the forward, backward and inward directions by the wall;

a plurality of tongues on the bottom of a generally vertical wall of the first storage unit corresponding to and positioned and configured to engage the openings in the top surface of a generally vertical wall of the second storage unit; and feet, integral with the first storage unit and configured and positioned to extend below the tongues on the first storage unit and to fit inside the generally vertical wall of the second storage unit; the tongues and feet forming an interlock groove for receiving the generally vertical wall of the second storage unit.

22. A water-bottle storage unit stackable on an underlying water-bottle storage unit, comprising:

a plurality of storage apertures defined by two or more rails contoured to support curved surface areas of one or more water-bottles;

a center wall extending to an elevation above the storage apertures and terminating in one or more tapered alignment tongues;

two side walls extending to an elevation above the storage apertures, each terminating in a sliding face having two or more alignment openings;

a rib structure underlying the apertures and interconnecting the rails and walls;

a tapered first alignment groove positioned below the center wall and configured to self-align the storage unit to the underlying storage unit and to receive the first tongue of the underlying storage unit to prevent lateral movement of the storage unit relative to the underlying storage unit;

a plurality of second alignment tongues extending from the bottom of the side walls end corresponding to the alignment openings or the underlying storage unit to engage the alignment openings of the underlying storage unit to prevent forward and backward movement of the storage unit relative to the underlying storage unit.

23. The water-bottle storage unit of claim 22 wherein the alignment openings are unequal in size to prevent incorrect orientation of the storage unit.

24. The water-bottle storage unit of claim 22 wherein each side wall terminates in a sliding face having three or more alignment openings; the alignment openings being unequally spaced to prevent incorrect orientation of the storage unit.

25. The water-bottle storage unit of claim 22 further comprising feet extending downwardly to a point below the second alignment tongues for supporting the storage unit on a generally flat surface.

26. The water-bottle storage unit or claim 25 wherein the feet fit inside of the walls of the underlying storage unit.

27. A method of stacking modular storage units comprising the steps of:

positioning a first self-centering alignment groove in a top storage unit over a first alignment tongue integral to a generally vertical wall of a bottom storage unit to restrain the storage units in alignment in a first direction; and sliding the top storage unit in a second direction essentially perpendicular to the first direction to engage a plurality of second alignment tongues extending from the bottom or the top storage unit with second alignment openings formed in one or more generally vertical walls of the bottom storage unit to restrain the storage units in alignment in the second direction.

28. The method of claim 27 wherein the generally vertical walls of the bottom storage unit are captured by interlock grooves formed between feet on the top storage unit extending inside the generally vertical walls or the bottom storage unit and the secondary alignment tongues; and wherein the top storage unit is prevented from dislodging from the bottom storage unit by the interlock grooves and the self-centering primary alignment groove.

* * * * *